United States Patent [19]

Deacon

[11] Patent Number: 4,658,611

[45] Date of Patent: Apr. 21, 1987

[54] LOCKING MEMBER INCORPORATING A CAM LEVER LOCK AND A SLIDING BOLT

[75] Inventor: Bryan Deacon, Chippenham, Great Britain

[73] Assignee: F. C. Brown (Steel Equipment) Limited, Bisley, United Kingdom

[21] Appl. No.: 753,331

[22] Filed: Jul. 9, 1985

[30] Foreign Application Priority Data

Jul. 12, 1984 [GB] United Kingdom ..... 8417729

[51] Int. Cl.[4] ..... E05B 65/06

[52] U.S. Cl. ..... 70/360; 70/128; 70/417; 70/434

[58] Field of Search ..... 70/360, 361, 451, 417, 70/461, 432, 434, 134, 129, 124, 125, 126, 127, 128

[56] References Cited

U.S. PATENT DOCUMENTS

| | | | |
|---|---|---|---|
| 1,512,939 | 10/1924 | Ledin | 70/134 |
| 1,661,454 | 3/1928 | Wilson | 70/461 |
| 2,117,715 | 5/1938 | Godfried | 70/417 |
| 3,599,454 | 8/1971 | Hill | 70/434 |
| 3,844,144 | 10/1974 | Schmitt | 70/417 |
| 4,530,223 | 7/1985 | Oliver | 70/417 |
| 4,565,080 | 1/1986 | Kincaid | 70/361 |

*Primary Examiner*—Robert L. Wolfe

*Attorney, Agent, or Firm*—Young & Thompson

[57] ABSTRACT

A locking member comprises a keyed cylinder 14 for a cam lever lock installed in a housing member 8 which is received within a mounting 4. The housing member 8 and mounting 4 are formed from case hardened steel. A bolt nose 19 projects from the housing member 8 and can be slid into a keeper 1. A slot in the housing member 8 can be aligned with either of two slots 12 and 13 for receipt of the cam plate 10 of the cam lever lock when the housing member 8 with the associated bolt nose 19 is in either the release position or the locking position respectively. Contactor plates 27 are provided in the wall of the mounting 4 and will be aligned with spring loaded pins held within blocks 29 to complete an electrical bridge circuit when the assembly is in either the locking or release positions so that the status of the locking member can be indicated at a remote point.

17 Claims, 9 Drawing Figures

LOCKING MEMBER INCORPORATING A CAM LEVER LOCK AND A SLIDING BOLT

This invention relates to lock mechanisms.

One of the problems of lock mechanisms is that as a generality, the higher the degree of security provided by the lock, the higher the cost of the lock and its installation. For example the cam lever lock is a relatively cheap lock for any given level of security as also is its cost of installation. However the vulnerability of such mechanisms usually lies in their basic construction and size in relation to the closure they secure. Conversely deadlocks, cylinder locks and padlocks are relatively more expensive than cam lever locks for the given level of required security. This "security versus cost" consideration is particularly true for lock mechanisms intended for surface mounting on a door or closure where they are more susceptible to both vandalism and the environment than interior mounted mechanisms.

The present invention seeks to utilise the "security versus cost" benefits of the cam lever lock and substantially increase its range of application, whilst reducing the vulnerability afforded by the conventional use of cam lever locks.

According to the invention there is provided a locking mechanism incorporating a cam lever lock installed within a housing member movable within a mounting between a locking position wherein a part of the housing member projects beyond one end of the mounting to be received in a keeper and a release position wherein said part of the housing member is withdrawn into the mounting, the housing member and mounting incorporating slots which will be mutually aligned in the locking position for receipt of the cam plate of the lock to secure the housing member and mounting together.

Such an arrangement provides substantial protection for the cam lever lock which is surrounded by the housing member and by the mounting when the parts are moved into the locking position. Ideally the housing member and the mounting are defined by hollow sections formed from case hardened steel.

The mounting will advantageously incorporate an additional slot which will be aligned with the slot in the housing member in the release position, for receipt of the cam plate of the lock to secure the housing member in the release position. It is also preferred that the cam plate should be mounted on an extension shaft, carried by the rotatable portion of the cam lever lock, which projects into the housing member. This enables the cam plate to be aligned with the additional slot in the mounting even when the housing member is withdrawn to some extent from the mounting into the release position. Preferably the cam plate will be adjustably mounted on the extension shaft. The housing member will preferably have a bolt head projecting as an extension thereof and the free end of the extension shaft of the cam lever lock can then be housed within a cavity in the end of the bolt head. An internal hardened steel roller within the bolt head will provide resistance to attempts to saw through the bolt head.

The mounting itself will preferably be provided with internal liners, at least some of which are formed from a material having a low coefficient of friction, to provide for easy sliding of the housing member within the mounting.

The locking member may include a compression plate to be secured to the mounting with a door section therebetween by bolts, screws or the like. This compression plate can have pillars extending therefrom to receive the ends of the fixing bolts, screws or the like.

In the preferred embodiment electrical bridge contacts are carried by the housing member and mounting to enable the status of the locking member to be sensed remotely. Thus the housing member may incorporate a block incorporating spring loaded electrically conductive pins which can project through a wall of the housing member and the mounting carries one or more contactor plates incorporating electrically conductive contactors which pass through a wall of the mounting and which will be aligned with the conductive pins at least in the locking position. A contactor plate may additionally be positioned for alignment of contactors with the conductive pins in the release position.

Another advantageous feature for the locking member is indicating means for indicating the locking status of the cam lever lock. Such indicating means could comprise a microswitch in an electrical circuit positioned to be actuated by the cam plate when the cam plate is in a predetermined position.

To provide a total kit the locking member can include also a keeper socket for receipt of the projecting part of the housing member and provided with means for securing the keeper socket onto a door jamb or surround. A retainer plate may also be provided and will incorporate a stop to prevent the housing member from being moved in the release direction beyond the release position.

The invention may be performed in various ways and a preferred embodiment thereof will now be described with reference to the accompanying drawings, in which.

Figure 1:
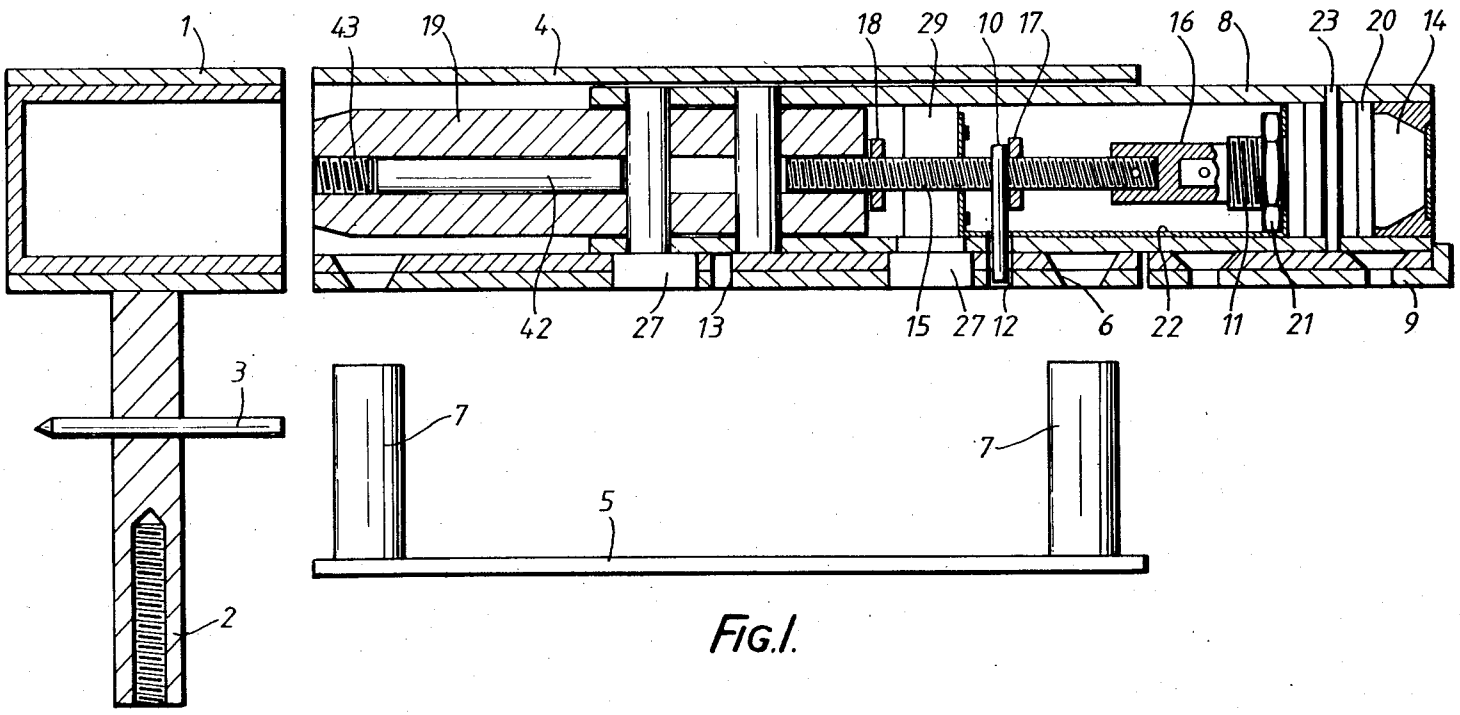
FIG. 1 is a vertical sectional view through a preferred form of locking member constructed in accordance with the invention in a release position.
Figure 2:
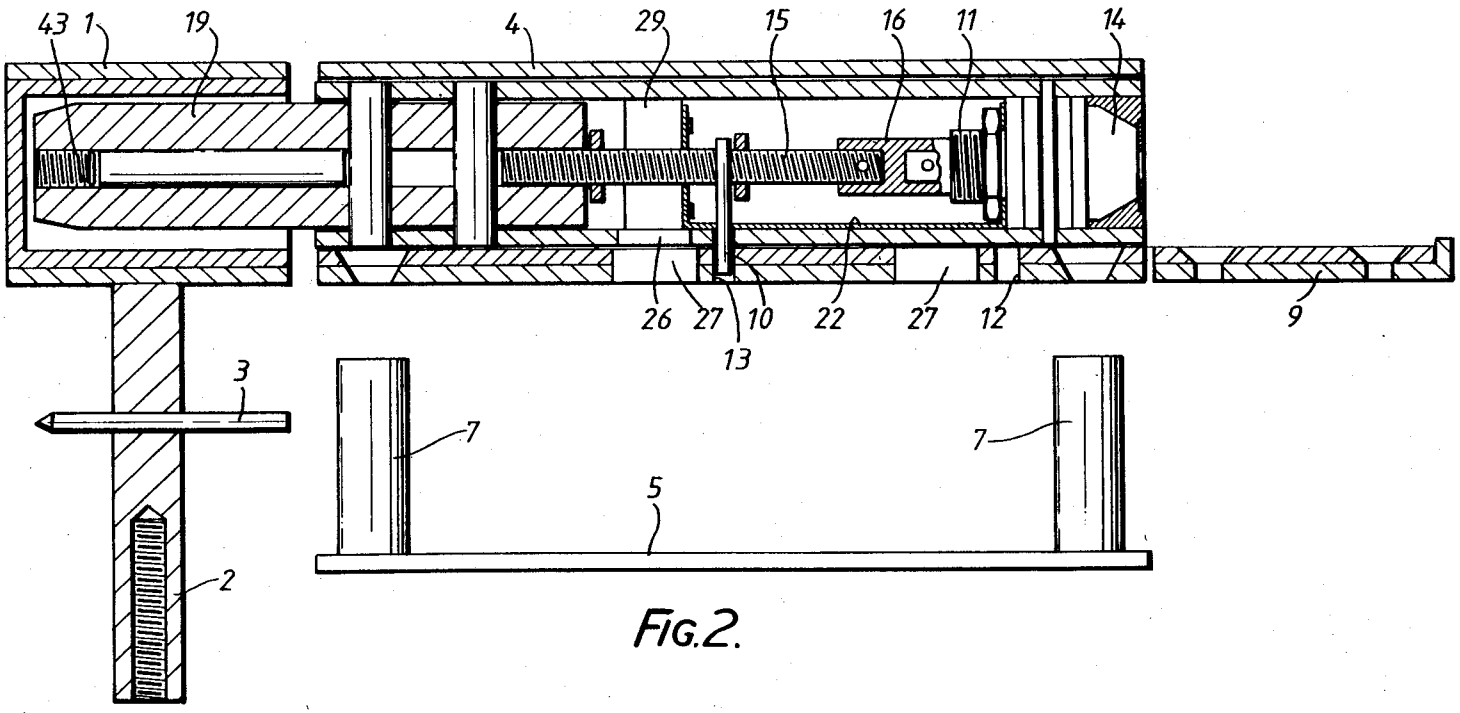
FIG. 2 is a similar view of the locking member in a locking position.

FIGS. 1 and 2 show a complete fastening suitable for locking an exterior opening door. An interior opening door would omit the socket keeper 1 and engage directly into the jamb or adjacent structure. The socket keeper is affixed to the jamb and/or adjacent structure by means of a coach bolt located into a previously drilled hole and brought into engagement with a threaded pillar 2 on the base of the socket keeper 1. A compression fixing is obtained by rotating the socket until the necessary degree of tightness is obtained, and then both orientating and locking off the assembly by driving a pin 3 through the jamb/pillar/jamb, and thereby achieving a blind compression fixing of the socket.

The outer case 4 is secured to the door by drilling two holes through the door structure and introducing the compression plate 5 from the rear of the door. The outer case 4 is now located above these openings and secured to the compression plate 5 by two counter sunk, socket headed, set screws which locate within the countersunk openings 6 of the outer case 4 and are tightened down into screw-threaded posts 7 of the plate 5 to provide a blind compression fixing by the use of an Allen key. If desired the posts 7 could be omitted so that the screws would enter simple threaded holes in the plate 5. This allows for fixing to a structure up to a thickness of the amount that the screws project from the outer case 4.

The locking bolt 8 is now positioned within the outer case 4 by sliding it in until a projection 37 (FIG. 6) from the side of the bolt body engages with and is stopped from further movement by the limits of a slot (not shown) in the side wall of the outer case 4 which accept the said projection. A retainer plate 9 is now affixed immediately to the rear of the outer case 4 with two wood screws. This plate 9 will now limit rear movement of the locking bolt 8 within the outer case 4 to a distance corresponding to an unfastened position of the bolt with the socket keeper 1. In both extremes of movement a cam plate 10 of the lock 11 is correctly located over respective open-position slot 12 and closed-position slot 13 formed in the base of the outer case 4.

To operate the mechanism, the correct key is inserted into the keyed cylinder 14 located at the rear of the locking bolt 8 and turning the key causes the cam plate 10 to rotate out of one of the locking slots 12, 13 of the outer case 4, and the locking bolt may now be slid to locate in the other extreme of its movement when the key is reverse turned and the key extracted.

Figure 3:
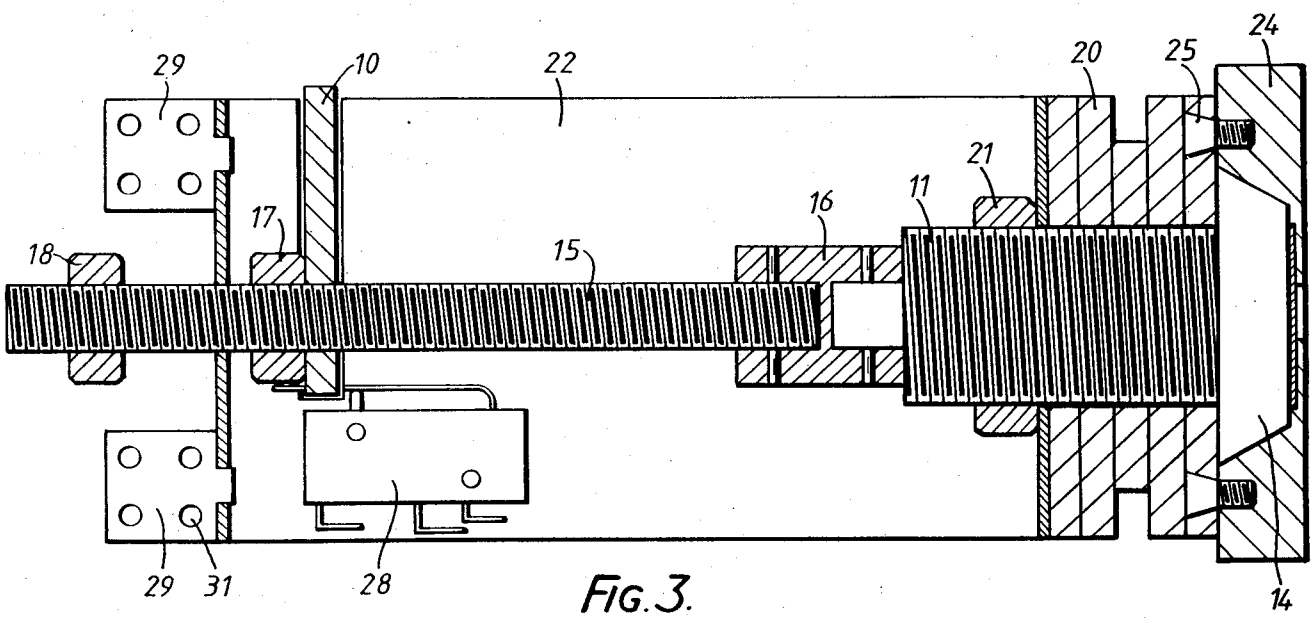
FIGS. 3 and 4 illustrate a detail of the lock assembly of the locking member in horizontal and vertical partial cross-sectional views respectively.
Figure 4:
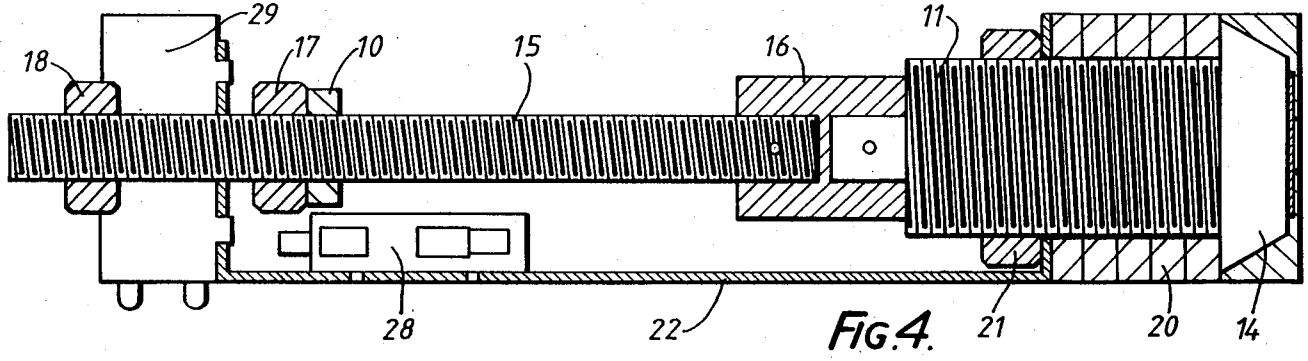

FIGS. 3 and 4 illustrate detailed features, including those of an electrical bridge, for the locking mechanism. A standard cam lever cylinder lock 14 is joined to a threaded extension shaft 15 by means of a pinned collar 16 designed to accommodate differing cam lever lock end stub profiles. The threaded extension shaft also allows for compensation for differing lengths of cam lever lock in that the actual cam plate 10 which is threaded on can always be made to relate to the locking slot in the base of the locking bolt 8 or locking case 4 which is a fixed distance irrespective of the lock body length. The cam plate 10 is securely locked onto the threaded shaft 15 by a lock nut 17. A further lock nut 18 is provided towards the end of the shaft and approximates to the end of the hollow bolt-head section 19 (FIGS. 1 and 2) within which the end of the threaded shaft locates. The purpose of this nut 18 is to provide a shoulder on the shaft 15 which will offer resistance to an impaction attack aimed at driving the keyed cylinder mechanism 14 through the body of the actual lock.

Five plates 20 with internal holes corresponding to the body profile of the cam lever lock are locked onto the body of the lock by a nut 21 which also secures an electrical bridge plate 22, if provided. One of the five plates (normally in the centre of the five) is shortened in width to provide access for two pins 23 (FIG. 1) which fix the locking mechanism within the body of the locking bolt case 8. A further machined plate 24 may be affixed to the rearmost plate of the five by two countersunk screws 25 to provide a higher degree of physical security, said plate being case hardened and containing a spinner to resist attack by drilling.

Figure 5:
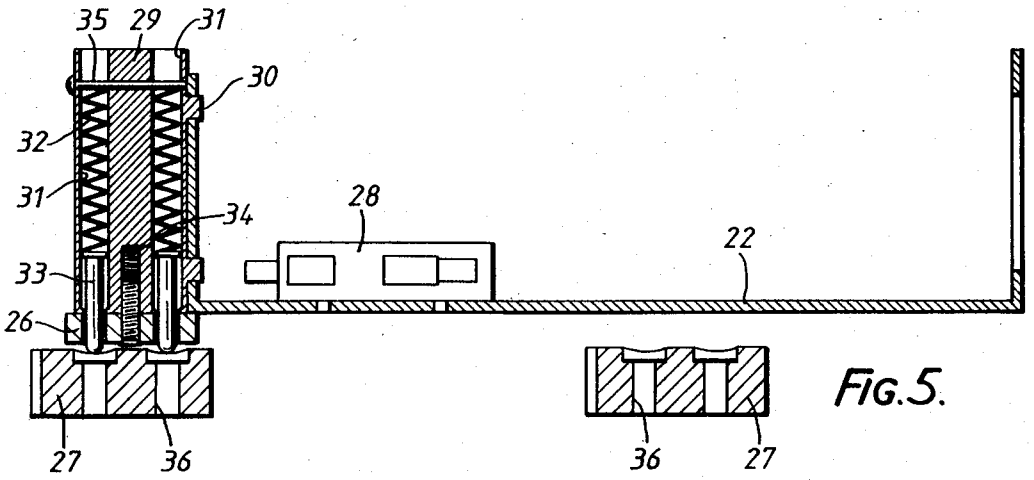
FIG. 5 is a vertical cross-section through details of an electrical bridge of the lock assembly.

In FIG. 5 is shown the electrical bridge plate 22, a contactor retainer plate 26 and two external contactor plates 27. The bridge consists of a flat platform with two ends turned up at ninety degrees, the rearmost end being holed as for the lockplates 20 and affixed thereto by the lock plate retaining nut 21. The platform 22 is slotted to permit free movement of the cam plate 10 and allows for the fixing of various electrical switching devices, (a microswitch 28 is shown). The front end of the platform 22 has a slot to allow passage of the threaded cam shaft 16 and a pair of twin holes which provide fixing points for electrical blocks 29. The blocks are of square section with two projections 30 for affixing to the platform, and four through holes 31 provide housings for insulated springs 32 and contactors 33. A limited length base hole 34 provides a screwed fixing point for the contactor retaining plate 26 and two or more through holes at right angles to the contactor housing holes provide fixings for conducting pins 35 which both retain the springs on final assembly and afford solder points for conducting received current into and, after actioning, out of the bridge mechanism. The two outer contactor plates 27 each contain four hollow rivets 36 within which suitable wires may be soldered. These plates 27 are located within the base of the outer case 4 by simple press fitting, their orientation being determined by projecting lips on their foremost ends. In assembly the conducting pins 35 are inserted into the blocks 29 and suitable wires are connected from the pins 35 to whichever device is affixed to the platform 22. The blocks 29 are now reversed and the springs 32 followed by the contactor pins 33 are inserted within the contactor holes 31 and are locked in by fitting the contactor retaining plate 22 with a suitable centre screw. Each conducting pin conveys current from one or more contactor pins 33 via their respective springs 32. The bridge is affixed to the lock plug and the whole assembly is mounted within the locking bolt case 8 with the two fixing pins 23.

In operation current is passed through the electrical bridge system when contactor pins 33 make contact with one of the external contactor plates 27. The current passes through the contactors 33 and their springs 32 to the conducting pins 35 from where it may either pass down on adjacent linked pins 33, or travel through an internal discrete device and pass acquired information back down a separate contactor pin 33 and then via the twinned contactor mounted on the outer contactor plate 27 through the door structure to either an alarm or alarm point. For example a current path may be established through the electrical bridge when the locking case 8 is in either of those two fixed positions which correspond to an open and closed position, said current then indicating the positional relationship of the locking case 8 in relation to the outer case 4. Passage of this current through the microswitch 28 (which is operated by the position of the cam plate 10) would also indicate keyed cylinder status. Electrical indication is therefore available on both positional and cylinder status on a continuous basis. The fitment of vibration, inertia and other devices within the body of the locking case 8 is simply a matter of choice and reflects the sophistication of information required.

Figure 6:
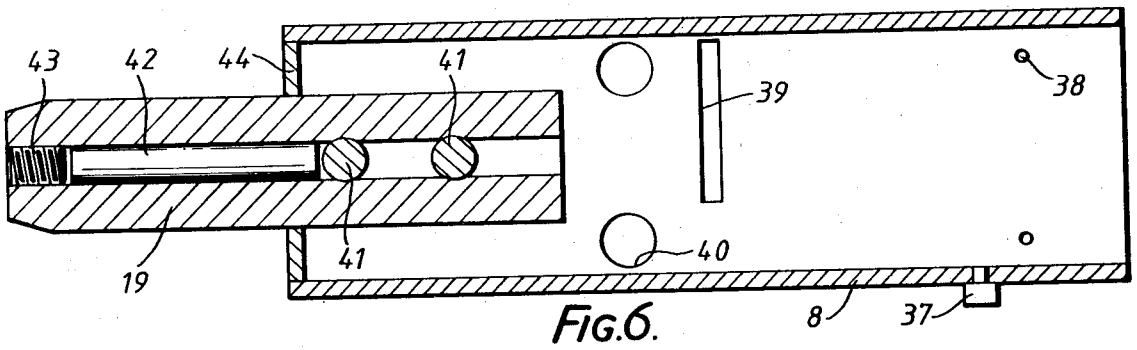
FIG. 6 is a horizontal section through parts of a bolt head of the locking member.

As can be seen from FIG. 6 the locking bolt case 8, which is of hollow rectangular section, carries the pin 37 which locates within a slot on the side body of the outer case 4 and limits forward movement of the locking bolt case 8. The case 8 also has two rear holes 38, for fixing pins 23, a cam access slot 39 and two further holes 40 to receive the blocks 29. Bolt retaining pins 41 are permanently fixed by welding to hold the bolt head 19 in place. The bolt head 19, which is hollow centred, contains a hardened steel roller 42 retained by the foremost fixing pin 41 and a grub screw or steel plug 43. The front end of the case 8 is finished with a press fit steel plate 44 of suitable dimension.

Figure 7:
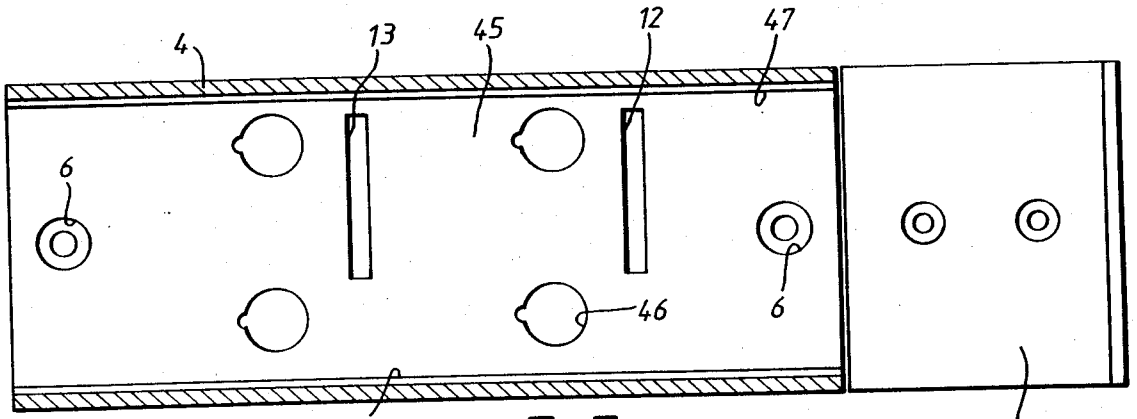
FIG. 7 is a horizontal cross-section through a mounting forming part of the locking member.

Further details of the outer case assembly 4 are shown in FIG. 7. The case 4 is of standard rectangular hollow section of sufficient dimension to allow for the easy sliding movement of the locking bolt case 8 within it. The case 4 has a slot (not shown) on a side wall which offers location to the projecting pin 37 on the locking case 8. The case 4 has a steel base liner 45 with the countersunk holes 6 at either end for final mounting of the case onto the compression plate 5. The two slots 12, 13 for cam plate entry and locking in the correct fastened and unfastened positions, and four holes 46 for the fitment of outer contactor plates 27 are provided. Two side liners 47 of a friction free material are provided and serve to both improve the sliding action and to accommodate the variance between the external dimensions of the locking case 4 and the internal dimensions of the outer case 8 which are, as previously mentioned, constructed from standard steel stock.

Figure 9:
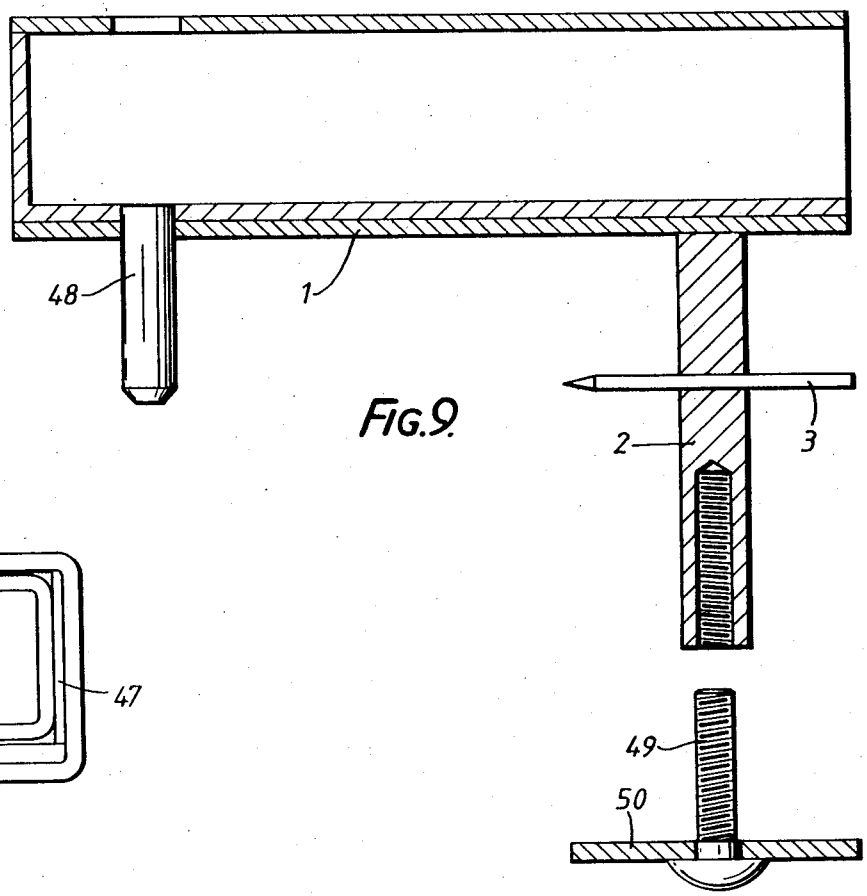
FIG. 9 is a vertical cross-section through an alternative form of socket keeper for the locking member.
Figure 8:
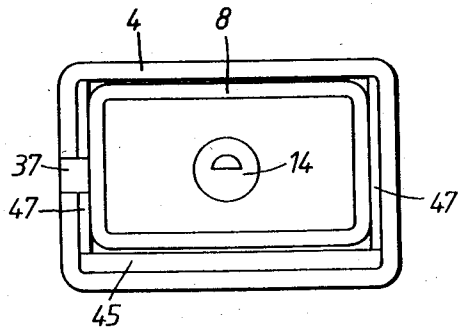
FIG. 8 is an end view of the locking member.

The end view of an unmounted locking bolt assembly shown in FIG. 8 illustrates the cylinder lock 14, the projecting pin 37 of the locking case 8 located in the slot in the outer case 4, the base liner 45, two side liners 47 and the outer case 4 itself. FIG. 9 is a side view of an extended socket keeper 1 as a simple extension of the socket keeper shown in FIG. 1. The continuation in length allows for a steel pin 48 to be driven into both the base of the keeper 1 and the underlying wall structure to provide a more substantial defence against impaction attacks on this end of the fastening by spreading the load which would normally bear totally on the jamb. The pillar 2 is fixed by a screw 49 having a bearing plate 50.

I claim:

1. A locking member comprising a mounting enclosure, a housing member and a cam lever lock having a cam plate and installed within the housing member, the housing member being slidably movable within the mounting enclosure between a locking position wherein an end part of the housing member projects beyond one end of the mounting enclosure to be received in a keeper and so that the remainder of the housing member is within the mounting enclosure, and a release position wherein said end part of the housing member is withdrawn into the mounting enclosure, slots being defined in both the housing member and the mounting enclosure, which slots will be mutually aligned in the locking position for receipt of the cam plate of the lock to secure the housing member and mounting enclosure together, and wherein a rotatable portion forms part of the cam lever lock, and an extension shaft projects from the rotatable part into the housing member, the cam plate being attached on the extension shaft for rotation therewith into and out of said aligned slots.

2. A locking member according to claim 1, wherein an additional slot is defined in the mounting enclosure, which slot will be aligned with the slot in the housing member in the release position, for receipt of the cam plate of the lock to secure the housing member in the release position.

3. A locking member according to claim 1, wherein the cam plate is adjustably mounted on the extension shaft.

4. A locking member according to claim 1, wherein the housing member has a bolt head projecting as an extension thereof.

5. A locking member according to claim 4, wherein a hardened steel roller is provided in the bolt head.

6. A locking member according to claim 3, wherein the housing member has a bolt head projecting as an extension thereof and the free end of the extension shaft is housed within a cavity defined in the end of the bolt head.

7. A locking member according to claim 1, wherein the mounting enclosure is provided with internal liners, at least some of which are formed from a material having a low coefficient of friction.

8. A locking member according to claim 1 wherein the housing member and the mounting enclosure are defined by hollow sections formed from case hardened steel.

9. A locking member according to claim 1, including a compression plate to be secured to the mounting enclosure with a door section therebetween by bolts, screws or the like.

10. A locking member according to claim 9, wherein pillars extend from the compression plate to receive the ends of the fixing bolts, screws or the like.

11. A locking member according to claim 1, including electrical bridge contacts which are carried by the housing member and the mounting enclosure to enable the status of the locking member to be sensed remotely.

12. A locking member according to claim 11, wherein the housing member incorporates a block incorporating spring loaded electrically conductive pins which can project through a wall of the housing member and the mounting enclosure carries one or more contactor plates incorporating electrically conductive contactors which pass through a wall of the mounting enclosure and which will be aligned with the conductive pins at least in the locking position.

13. A locking member according to claim 12, wherein a contactor plate is positioned for alignment of contactors with the conductive pins in the release position.

14. A locking member according to claim 1, including indicating means for indicating the locking status of the cam lever lock.

15. A locking member according to claim 14, wherein said indicating means comprises a microswitch in an electrical circuit positioned to be actuated by the cam plate when the cam plate is in a predetermined position.

16. A locking member according to claim 1, including a keeper socket for receipt of the projecting part of the housing member and provided with means for securing the keeper socket onto a door jamb or surround.

17. A locking member according to claim 1, including a retainer plate incorporating a stop to prevent the housing member from being moved in the release direction beyond the release position.

* * * * *